US005598063A

United States Patent [19]

Mathews et al.

[11] Patent Number: 5,598,063

[45] Date of Patent: Jan. 28, 1997

[54] MEANS FOR SUPPORTING AND SEALING THE LEAD STRUCTURE OF A LAMP

[75] Inventors: Paul G. Mathews, Chesterland; Martin N. Hassink, Macedonia, both of Ohio

[73] Assignee: General Electric Company, Schenectady, N.Y.

[21] Appl. No.: 991,603

[22] Filed: Dec. 16, 1992

[51] Int. Cl.[6] ..... H01J 61/36

[52] U.S. Cl. ..... 313/623; 313/626

[58] Field of Search ..... 313/623, 626, 313/284, 285

[56] References Cited

U.S. PATENT DOCUMENTS

| | | | |
|---|---|---|---|
| 2,138,224 | 11/1938 | Barasch | 313/623 |
| 2,245,394 | 1/1941 | Francis et al. . | |
| 2,316,999 | 7/1941 | Spencer . | |
| 3,315,116 | 4/1967 | Beese | 313/623 |
| 4,038,578 | 7/1977 | Mathijssen | 313/623 |
| 4,202,999 | 5/1980 | Holle et al. . | |
| 4,254,356 | 3/1981 | Karikas | 313/332 |
| 4,559,472 | 12/1985 | Triebel et al. | 313/623 |
| 5,025,192 | 6/1991 | Okamoto | 313/623 |
| 5,077,505 | 12/1991 | Ekkelboom et al. | 313/623 |

FOREIGN PATENT DOCUMENTS 2072937 3/1980 United Kingdom .

*Primary Examiner*—Sandra L. O'Shea
*Assistant Examiner*—Vip Patel
*Attorney, Agent, or Firm*—George E. Hawranko

[57] ABSTRACT

This lamp comprises an envelope of vitreous light-transmitting material enclosing an internal space, light-generating means within said space, and conductive lead structure projecting into said space and comprising inner and outer lead members and a foil member connected between said lead members. A first portion of the envelope surrounds the foil member and is sealed thereto, and a second portion of the envelope is located inwardly of the first portion. A tubular bead of vitreous material is provided about the inner lead member. This bead fits within the second envelope portion, is joined thereto, and supports the inner lead member in a precise predetermined portion within the envelope. The inner lead member projects inwardly beyond the bead and provides support for the light-generating means.

18 Claims, 4 Drawing Sheets

Fig. 1
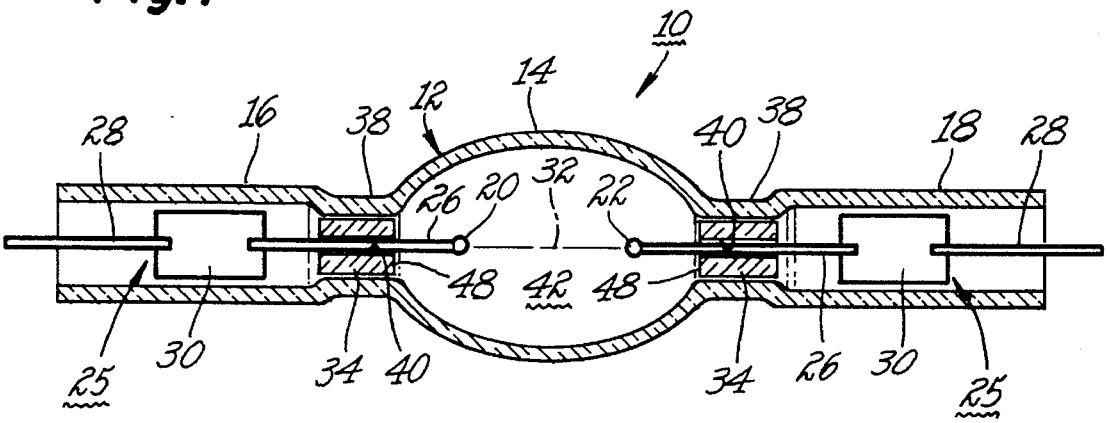
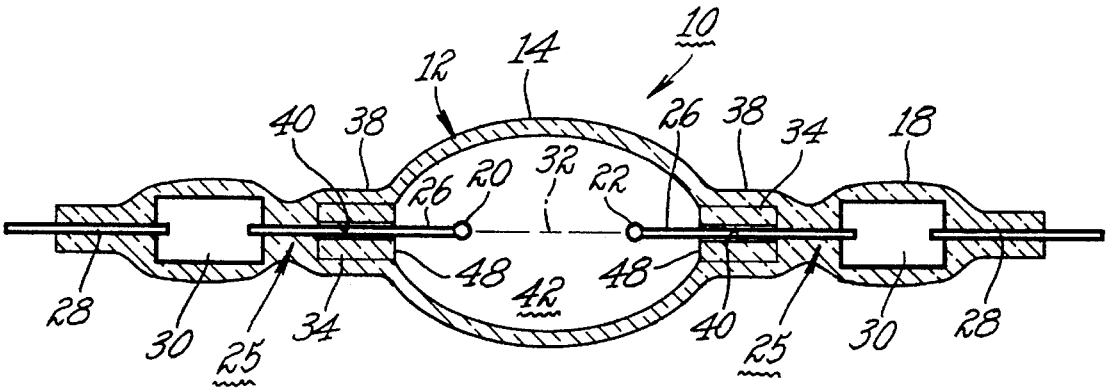
Fig. 2

Fig. 5
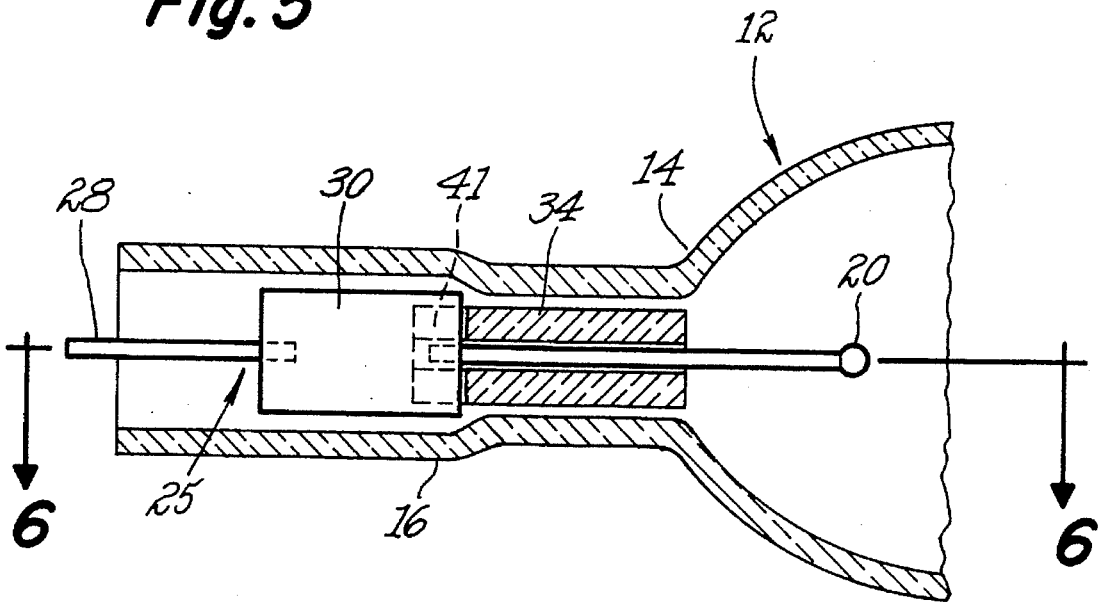
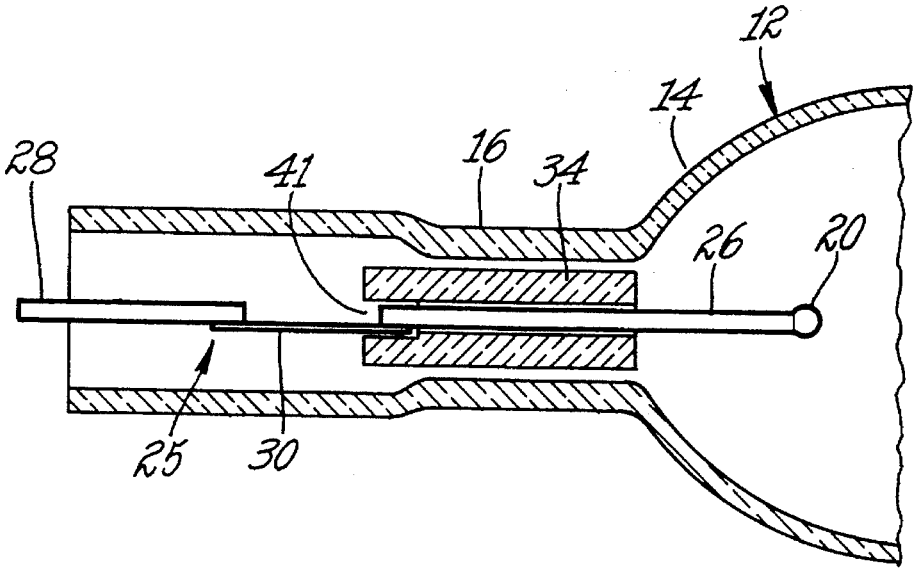
Fig. 6

MEANS FOR SUPPORTING AND SEALING THE LEAD STRUCTURE OF A LAMP

TECHNICAL FIELD

This invention relates to a lamp that comprises (i) an envelope of vitreous light-transmitting material enclosing an internal space where light is generated, (ii) conductive metallic lead structure projecting into said internal space, and (iii) means for supporting said lead structure on said envelope and forming a seal between said lead structure and said envelope.

BACKGROUND

In certain lamps of the above type, it is important that the light-generating means be precisely located in a predetermined position within the envelope of the lamp. For example, in a metal-halide discharge lamp, light is generated by an arc developed between spaced electrode tips, and these tips must be precisely located with respect to each other and the surrounding envelope in order to achieve proper envelope, or arc-tube, temperature distribution and desired optical properties, life, and lumen output. The electrode tips are located by supporting them on leads which extend through openings in the envelope, and seals are formed between the envelope and the leads in order to support the leads on the envelope and to prevent any leakage in this region. The seals can be either of the pinch-seal type or the shrink-seal type.

One obstacle to achieving precise positioning of the electrode tips is the difficulty of making the seals without introducing such distortion of the sealing regions of the envelope that displaces the leads and electrode tips from the precise positions desired. We are concerned with providing a seal and support structure for the leads that lends itself to achieving precise positioning of the light-generating means, for example, the electrode tips in the case of a discharge lamp.

One technique that has been used for achieving the desired positioning of the electrode tips has been to provide a metal coil about the supporting lead and to seal the outer portion of this coil to the surrounding leg of the quartz envelope. Such a coil serves to restrict movement of the supporting lead and the electrode tip mounted thereon, thereby decreasing electrode runout, i.e., displacement of the electrode tip from its predetermined desired position. The coil also serves to keep the quartz from wetting the refractory-metal supporting lead and thus eliminates shaling (i.e., cracking of the quartz in the immediate region of any refractory-metal part bonded thereto) as a result of unequal thermal expansion of the quartz and the refractory metal. A coil of this general type is disclosed and claimed in U.S. Pat. No. 4,942,331—Bergman, assigned to the assignee of the present invention.

A significant disadvantage of using a coil in this location is that the coil leaves a large cavity at the back of the arc chamber of the lamp. During lamp operation, the cavity tends to operate at a much cooler temperature than the rest of the arc chamber, and, as a result, certain metallic and metal halide components of the arc-chamber fill condense there, causing inferior arc-tube performance.

Another disadvantage of using a coil in this location is that during starting the arc may attach to the coil end exposed to the interior of the arc chamber. This can overheat the quartz in the adjacent area and cause early lamp failure.

We are concerned with providing support and sealing structure which limits electrode runout, substantially eliminates shaling, and causes the region of the lamp at the back of the arc chamber to operate at an acceptable temperature.

We are also concerned with providing a repeatable end chamber shape and eliminating the use of small conducting wires which can provide an unintentional arc spot.

SUMMARY

In carrying out our invention in one form, we provide an envelope of vitreous light-transmitting material enclosing an internal space, light-generating means within said internal space, and conductive lead structure projecting into said internal space and comprising an inner lead member, an outer lead member, and a foil member connected between said inner and outer lead members. The envelope includes a first envelope portion surrounding the foil member and sealed thereto and a second envelope portion of tubular form located inwardly of the first envelope portion. A tubular bead of vitreous material is provided about the inner lead member. This bead fits within said second envelope portion, is joined thereto, and supports the inner lead member in a precise predetermined position within the envelope. The inner lead member projects inwardly beyond the bead and provides support for the light-generating means.

In one form of the invention, the tubular bead is of quartz and the inner lead member is of a refractory metal; and the tubular bead member has a slightly larger internal diameter than the outer diameter of the lead member, thereby avoiding wetting of the inner lead member by the quartz of said bead during the heating operations involved in manufacture of the lamp.

BRIEF DESCRIPTION OF DRAWINGS

For a better understanding of the invention, reference may be had to the following detailed description taken in connection with the accompanying drawings, wherein:

FIG. 1 is a sectional view showing a partially-completed lamp embodying one form of our invention.

FIG. 2 is a sectional view similar to FIG. 1 except showing the completed lamp.

FIG. 5 is a sectional view of a portion of a partially-completed lamp embodying another modified form of the invention.

FIG. 6 is a sectional view along the line 6—6 of FIG. 5.

DETAILED DESCRIPTION OF EMBODIMENT

Figure 3:
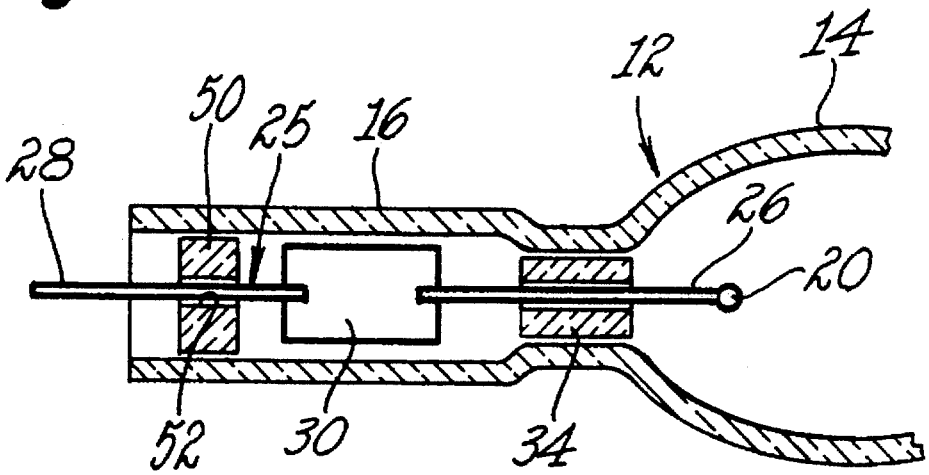
FIG. 3 is a sectional view showing a portion of a partially-completed lamp embodying another form of our invention.

Referring now to FIG. 1, the lamp 10 shown therein comprises a double-ended envelope 12 of vitreous light-transmitting material, such as fused quartz. This envelope comprises a bulbous central portion 14 and two integral legs 16 and 18 extending in opposite directions therefrom. The lamp is a discharge lamp comprising a pair of spaced-apart electrode tips 20 and 22 located within the internal space enclosed by the bulbous central portion 14.

For supporting the electrode tips and for connecting them in an electric circuit, two lead structures 25 are provided at opposite ends of the lamp. Since in the illustrated embodiment these lead structures are substantially identical, only one, the left-hand one, will be described in detail. This lead structure comprises an inner lead member 26, an outer lead member 28, and a foil member 30 connected between the two lead members. The lead members are of a refractory metal, such as tungsten or molybdenum, and the foil member is preferably of molybdenum. The spaced ends of the lead members 26 and 28 are welded to the foil member 30 in a conventional manner.

For achieving the desired optical properties, life, and lumen output from the lamp, it is important that the electrode tips be located in precise predetermined positions within the lamp envelope. In most cases, these predetermined positions are along the central longitudinal axis 32 of the bulbous portion 14 of the lamp. To aid in so locating each of the electrode tips, we provide a tubular bead 34 of vitreous material, preferably quartz, around each of the inner lead members 26. FIG. 1 shows the lead structures located within the legs 16 and 18 of the envelope but before seals have been made between legs and their associated lead structures. When the components are in their condition of FIG. 1, the outer diameter of the bead 34 is slightly less than the inner diameter of the portion 38 of the quartz leg 16 in which the bead fits. The inner diameter of the bead 34 is slightly larger than the outer diameter of the inner lead member 26 that it surrounds.

After the parts of the lamp have been positioned as shown in FIG. 1, a seal is made in a conventional manner about each of the foil members 30 and the surrounding quartz leg 16 or 18. This is accomplished by heating the portion of the quartz leg surrounding the foil member until the quartz is softened and then causing the softened quartz to collapse about the foil member. Such collapse can be produced by pressing with suitable tools applied to the exterior of the leg (in the case of a pinch seal) or by developing a pressure differential between the outside and inside of the tubular leg 16 (in the case of a shrink seal). The above-described heating can be effected either with a rotary burner or with a ring-type burner surrounding the leg.

The same heating operation that is used for making a seal to the foil member 30 is also used for making a seal between the leg portion 38 and the quartz bead 34. More specifically, the quartz of the leg portion 38 is heated to a softened state and then caused to collapse about the bead 34, thereby making a seal between the inner periphery of the leg and the outer periphery of the bead.

After these seals have been made, the quartz components have the form shown in FIG. 2. The bore 40 of the tubular bead 34 remains slightly larger in diameter than the outer diameter of the inner lead member 26, thus preventing the heated quartz of the bead from wetting the lead member during the sealing operation. Avoiding such wetting enables us to avoid the undesirable shaling action that typically results when quartz is bonded to a refractory metal and unequal thermal expansion of the two materials occurs. When such a bond is present, cracking, or shaling, of the quartz in the immediate region of the metal part typically occurs when the bonded region is heated.

Although a slight gap is present between the bore 40 of the quartz bead 34 and the inner lead member 26, this gap is so small that no significant lateral displacement of the lead member with respect to the bead can occur.

Although the lead member 26 has a short region located between the foil member 30 and the lead 40 where the quartz of leg 16 might wet the lead when the leg 16 is collapsed into its FIG. 2 shape, the effects of this can be lessened by keeping this region very short and by treating the surface of the lead member 26 in such a way that no substantial bonding occurs between the quartz of the envelope and the lead member in this region. For example, the lead member surface in this region can be anodized or can be otherwise processed or prepared so as to lessen the tendency for wetting to occur as a result of the collapse of the vitreous material of the leg 16 during the sealing operation.

One way of effectively shortening the region of the lead member 26 that is located between the foil member 30 and the tubular bead 34, the desirability of which is noted in the immediately-preceding paragraph, is to extend the bead 34 backwardly along the lead member 26 into close proximity with the foil member. FIGS. 5 and 6 illustrate a specific embodiment employing this approach. In FIGS. 5 and 6 bead 34 not only extends back to the foil member 30 but overlaps it, being provided with a notch 41 at its back end for receiving the foil member. When the surrounding quartz leg 16 of the envelope is heat-softened and then collapsed about this structure during the subsequent sealing operation, softened quartz is caused to fill this notch 41 and also to form a seal with the foil member over most of the surface of the foil member.

The internal space 42 within the lamp envelope is filled with a suitable gaseous fill, such as one containing a metal halide and a small amount of mercury. This fill can be introduced in any suitable conventional manner following appropriate evacuation of the internal space. An electric arc developed between the electrode tips 20 and 22 and within this gaseous fill, acts in a conventional manner to generate light that is transmitted outwardly therefrom and through the light-transmitting envelope 12.

A significant advantage of using a bead such as 34 in the illustrated location is that its presence eliminates the usual large cavity that is present behind the electrode tip 20 and within the leg 16. As pointed out hereinabove under "BACKGROUND", a metal coil sometimes has been used in this location to hold the inner lead member in the desired position. But this coil leaves a large cavity around the lead member that is open to the arc chamber. During lamp operation, this cavity tends to operate at a much cooler temperature than the rest of the arc chamber, with the result that mercury or metal halides from the fill condense there, causing inferior arc tube performance. Although in our lamp there is a very small gap between the lead member 26 and the surrounding bead 34 that is open to the arc chamber, this gap is so small that it will be heated sufficiently by heat from the lead member to avoid condensation of mercury and metal halides there. It will be noted that the quartz bead 34 terminates at its inner end in an inner end face 48 that is substantially flush with the internal surface of the arc chamber that surrounds the bead, thus leaving no cavity in this region that can operate at such a low temperature as to promote condensation of the metallic components of the fill there.

The quartz bead 34 at the right-hand end of the envelope functions in the same manner as the above-described bead within leg 16 to precisely locate its associated lead member 26 and to eliminate the presence of a large condensation-prone cavity behind the adjacent electrode tip.

Another advantage of our design over a design that uses a metal coil for positioning each lead is that there is no exposed metal around the lead to which an arc terminus might attach, e.g., during starting of the lamp. Such a condition could cause the arc to overheat the adjacent quartz and produce an early lamp failure.

While in a preferred embodiment of our invention the tubular beads (34) are of quartz, the invention in its broader aspects comprehends a design in which the beads are of other appropriate materials, e.g., high-silica glasses with slightly lower softening points than quartz, e.g., the glasses sold by Corning Glass Works, Corning, N.Y., under the trademark Vycor or the GS1 sealing glass of General Electric Company, Cleveland, Ohio.

While we have shown the invention as applied to a discharge-type lamp, it could also be applied to an incandescent lamp, e.g., a double-ended quartz lamp. In such a lamp, a filament is connected between the inner ends of the two leads, as illustrated, for example, in the aforesaid Bergman et al U.S. Pat. No. 4,942,331. In such a lamp, the beads (34) would serve to precisely position the filament, e.g., on the central longitudinal axis of the lamp so that the filament is optimally located to receive infrared radiation reflected from a special coating on the lamp envelope.

While in the illustrated embodiment, the two halves of the lamp on opposite sides of a central transverse plane are substantially identical, it is to be understood that use of the invention is not limited to such a symmetrical design. For example, it is also applicable to a DC discharge lamp in which the anode and the cathode electrodes are of specialized and different forms. It is also applicable to lamps optimized for base-up or base-down operation where asymmetrical designs might be used.

Figure 4:
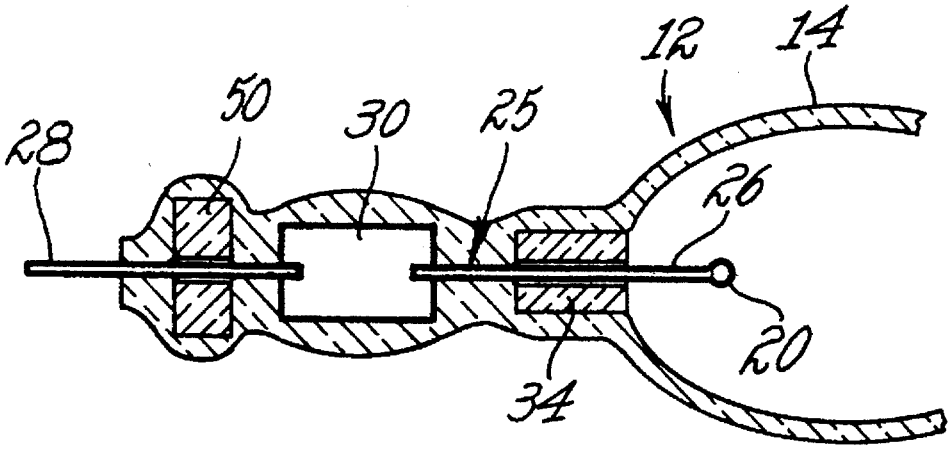
FIG. 4 is a sectional view similar to FIG. 3 except showing the completed lamp.

In a modified form of the invention shown in FIGS. 3 and 4, we provide additional assistance in positioning the lead structure 25 within the surrounding quartz leg 16 of the envelope just prior to and during the sealing operation. This additional assistance takes the form of another tubular bead 50 of vitreous material, this bead surrounding the outer lead member 28 in a location to the left of the foil member 30. This bead 50 has a bore 52 slightly larger than the outer diameter of the outer lead member 28. During the sealing operation the leg 16 of the envelope is heated to its softening point and caused to collapse about the lead structure 25, not only in the region around the inner bead 34 and the foil member 30, as described in connection with FIGS. 1 and 2, but also about the outer bead 50, producing the structure illustrated in FIG. 4. The FIG. 4 structure is the same as the FIG. 2 structure except in the region where the additional bead 50 is located.

Figure 7:
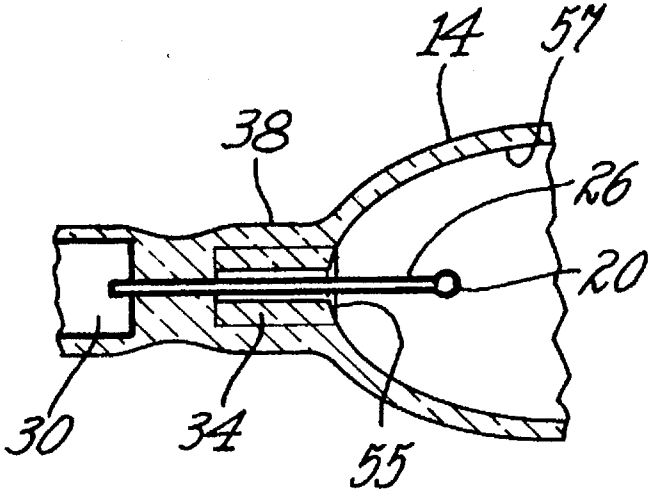
FIG. 7 is a sectional view of a portion of a lamp embodying still another modified form of the invention.

In still another embodiment of the invention, illustrated in FIG. 7, the quartz bead 34 has a concave, or cupped, inner surface 55 located just behind the electrode 20 that provides a predetermined end chamber geometry. In one specific form of this embodiment, the end chamber geometry at 55 is a continuation of the theoretical ellipsoidal shape of the inner surface 57 of the bulb 14. The controlled end chamber configuration reduces geometrical variation and provides thermal control.

In the symmetrical lamp design illustrated in FIGS. 1 and 2, the inner surfaces of the two quartz beads 34 are preferably identically shaped. However, the invention in its broader aspects is not so limited. For example, in the asymmetrical lamp design referred to hereinabove, the two beads can have different inner surface geometries to achieve the desired performance enhancement.

While we have shown and described a particular embodiment of our invention, it will be obvious to those skilled in the art that various changes and modifications may be made without departing from the invention in its broader aspects; and we, therefore, intend herein to cover all such changes and modifications as fall within the true spirit and scope of our invention.

What we claim is:

1. A lamp comprising:

(a) an envelope of vitreous light-transmitting material enclosing an internal space where light is generated, (b) a light-generating means within said internal space, (c) conductive lead structure projecting into said internal space and comprising an inner lead member, an outer lead member, and a foil member connected between said inner and outer lead members, and in which:

(d) said envelope includes a first envelope portion surrounding said foil member and sealed thereto, (e) said envelope further includes a second envelope portion of tubular form located closer to the internal space than said first envelope portion, and (f) a tubular bead of vitreous material is provided about said inner lead member; said bead fitting within said second envelope portion, sealingly joined thereto, and supporting said inner lead member in a precise predetermined position within said envelope; said inner lead member projecting inwardly beyond said bead and providing support for said light-generating assembly at the inner end of said inner lead member.

2. The lamp of claim 1 in which said bead is of quartz or high-silica glass and said inner lead member is of a refractory metal, said bead has a slightly larger internal diameter than the outer diameter of the portion of said inner lead member located within said bead, thereby avoiding wetting of said inner bead member by the quartz or glass of said bead during the heating operations involved in manufacture of said lamp.

3. The lamp of claim 1 in which said bead is of quartz or high-silica glass and said inner lead member is of a refractory metal, said bead has a bore slightly larger than the exterior of the portion of the inner lead member positioned therein so that a slight gap is present between said bore and said inner lead member, thereby avoiding wetting of said inner lead member by the quartz or glass of said bead during the heating operations involved in manufacture of said lamp.

4. The lamp of claim 3 in which said tubular bead extends from said internal space outwardly along said inner lead member into close proximity with said foil member.

5. The lamp of claim 1 in which:

(a) said internal space is bounded by a portion of said envelope having an internal surface surrounding said light-generating means, and (b) said bead terminates at its inner end in an inner end surface that is substantially flush with the portion of said internal surface surrounding said bead.

6. The lamp of claim 5 in which:

(a) said lamp is a discharge lamp, and (b) said light-generating means comprises a pair of electrode tips, one of which is mounted on said inner lead member at the inner end thereof.

7. The lamp of claim 1 in which:

(a) said internal space is bounded by a portion of said envelope having an internal surface surrounding said light-generating means, and (b) a fill containing metallic components in a vapor state during lamp operation is present in said internal space, (c) said bead terminates at its inner end in an inner end surface that is so shaped and located that there is no cavity around said inner lead member communicating with said internal space where substantial condensation of said metallic components will occur during lamp operation.

8. The lamp of claim 7 in which:

(a) said lamp is a discharge lamp, and (b) said light-generating means comprises a pair of electrode tips, one of which is mounted on said inner lead member at the inner end thereof.

9. The lamp of claim 1 in which:

(a) said lamp is a discharge lamp, and (b) said light-generating means comprises a pair of electrode tips, one of which is mounted on said inner lead member at the inner end thereof.

10. The lamp of claim 1 in which:

(a) said envelope further includes a third envelope portion of tubular form located further from the internal space than said first envelope portion, and (b) a second tubular bead of vitreous material is provided about said outer lead member, said second tubular bead fitting within said third envelope portion, joined thereto, and supporting said outer lead member in a precise predetermined position within said envelope.

11. The lamp of claim 1 in which said bead terminates at its inner end in an inner end surface that has a concave configuration.

12. The lamp of claim 1 in which:

(a) said internal space is bounded by a portion of said envelope having an internal surface surrounding said light-generating means, said internal surface having an essentially ellipsoidal configuration in the region around said bead, and (b) said bead terminates at its inner end in an inner end surface of concave configuration that is a continuation of said envelope inner-surface region of ellipsoidal configuration.

13. A lamp comprising:

(a) an envelope of vitreous light-transmitting material enclosing an internal space where light is generated, (b) a light generating means within said internal space, (c) conductive lead structure projecting into said internal space and comprising an inner lead member, and in which:

(d) said envelope includes a first envelope portion surrounding said lead structure and sealed thereto, (e) said envelope further includes a second envelope portion of tubular form located closer to the internal space than said first envelope portion, and (f) a tubular bead of vitreous material is provided about said inner lead portion; said bead fitting within said second envelope portion, sealingly joined thereto, and supporting said inner lead member in a precise predetermined position within said envelope; said inner lead member projecting inwardly beyond said bead and providing support for said light-generating assembly at the inner end of said inner lead member.

14. The lamp of claim 13 in which said bead is of quartz or high-silica glass and said inner lead member is of a refractory metal, said bead has a bore slightly larger than the exterior of the inner lead member positioned therein so that a slight gap is present between said bore and said inner lead member, thereby avoiding wetting of said inner lead member by the quartz or glass of said bead during the heating operations involved in manufacture of said lamp.

15. The lamp of claim 13 in which said bead terminates at its inner end in an inner end surface that has a concave configuration.

16. The lamp of claim 13 in which:

(a) said internal space is bounded by a bulbous portion of said envelope having an internal surface surrounding said light-generating means, said internal surface having an essentially ellipsoidal configuration in the region around said bead, and (b) said bead terminates at its inner end in an inner end surface of concave configuration that is a continuation of said envelope inner-surface region of ellipsoidal configuration.

17. A lamp comprising:

(a) an envelope of vitreous light-transmitting material enclosing an internal space where light is generated, (b) a light-generating means within said internal space, (c) conductive lead structure projecting into said internal space and comprising an inner lead member, an outer lead member, and a foil member connected between said inner and outer lead members, and in which:

(d) said envelope includes a first envelope portion surrounding said foil member and sealed thereto, (e) said envelope further includes a second envelope portion of tubular form located closer to the internal space than said first envelope portion, and (f) a tubular bead of vitreous material is provided about said inner lead member; said bead fitting within said second envelope portion, sealingly joined thereto, and supporting said inner lead member in a precise predetermined position within said envelope; said inner lead member projecting inwardly beyond said bead and providing support for said light-generating assembly at the inner end of said inner lead member, a quartz or high-silica glass and said inner lead member is a refractory metal, said bead has a bore slightly larger than the exterior of the portion of the inner lead member positioned therein so that a slight gap is present between said bore and said inner lead member, thereby avoiding wetting of said inner lead member by the quartz or glass of said bead during the heating operations involved in manufacture of said lamp, said tubular bead extends from said internal space outwardly along said inner lead member into close proximity with said foil member, and said tubular bead has an outer end portion containing a notch in which said foil member is received.

18. A lamp comprising:

(a) an envelope of vitreous light-transmitting material enclosing an internal space where light is generated, (b) a light-generating means within said internal space, (c) conductive lead structure projecting into said internal space and comprising an inner lead member, an outer lead member, and a foil member connected between said inner and outer lead members, and in which:

(d) said envelope includes a first envelope portion surrounding said foil member and sealed thereto, (e) said envelope further includes a second envelope portion of tubular form located closer to the internal space than said first envelope portion, and (f) a tubular bead of vitreous material is provided about said inner lead member; said bead fitting within said second envelope portion, sealingly joined thereto, and supporting said inner lead member in a precise predetermined position within said envelope; said inner lead member projecting inwardly beyond said bead and providing support for said light-generating assembly at the inner end of said inner lead member, a quartz or high-silica glass and said inner lead member is a refractory metal, said bead has a bore slightly larger than the exterior of the portion of the inner lead member positioned therein so that a slight gap is present between said bore and said inner lead member, thereby avoiding wetting of said inner lead member by the quartz or glass of said bead during the heating operations involved in manufacture of said lamp, said tubular bead extends from said internal space outwardly along said inner lead member into close proximity with said foil member, and said tubular bead has an outer end portion that extends outwardly along said inner lead member into overlapping relationship with said foil member.

* * * * *